US008178835B2

(12) United States Patent
Remes et al.

(10) Patent No.: US 8,178,835 B2
(45) Date of Patent: May 15, 2012

(54) PROLONGED ION RESONANCE COLLISION INDUCED DISSOCIATION IN A QUADRUPOLE ION TRAP

(75) Inventors: Philip M. Remes, Berkeley, CA (US); Jae C. Schwartz, Gilroy, CA (US)

(73) Assignee: Thermo Finnigan LLC, San Jose, CA (US)

( * ) Notice: Subject to any disclaimer, the term of this patent is extended or adjusted under 35 U.S.C. 154(b) by 168 days.

(21) Appl. No.: 12/620,525

(22) Filed: Nov. 17, 2009

(65) Prior Publication Data

US 2010/0282963 A1 Nov. 11, 2010

Related U.S. Application Data

(60) Provisional application No. 61/176,349, filed on May 7, 2009.

(51) Int. Cl.
*H01J 49/42* (2006.01)

(52) U.S. Cl. ..... 250/292; 250/282

(58) Field of Classification Search ..... 250/281–300
See application file for complete search history.

(56) References Cited

U.S. PATENT DOCUMENTS

| | | | |
|---|---|---|---|
| 4,736,101 | A | 4/1988 | Syka et al. |
| 4,882,484 | A | 11/1989 | Franzen et al. |
| 5,075,547 | A | 12/1991 | Johnson et al. |
| 5,128,542 | A | 7/1992 | Yates et al. |
| 5,134,286 | A | 7/1992 | Kelley |
| 5,200,613 | A | 4/1993 | Kelley |
| 5,206,509 | A | 4/1993 | McLuckey et al. |
| 5,274,233 | A | 12/1993 | Kelley |
| 5,298,746 | A | 3/1994 | Franzen et al. |
| 5,302,826 | A | 4/1994 | Wells |
| 5,324,939 | A | 6/1994 | Louris et al. |
| 5,352,890 | A | 10/1994 | Johnson et al. |
| 5,381,006 | A | 1/1995 | Wells et al. |
| 5,381,007 | A | 1/1995 | Kelley |
| 5,396,064 | A | 3/1995 | Wells |
| 5,404,011 | A | 4/1995 | Wells et al. |
| 5,436,445 | A | 7/1995 | Kelley et al. |
| 5,457,315 | A | 10/1995 | Wells et al. |
| 5,508,516 | A | 4/1996 | Kelley |
| 5,517,025 | A | 5/1996 | Wells et al. |

(Continued)

FOREIGN PATENT DOCUMENTS

| | | |
|---|---|---|
| WO | WO 03/041107 | 5/2003 |

OTHER PUBLICATIONS

Schwartz et al., "High Resolution Parent-Ion Selection/Isolation Using a Quadrupole Ion-Trap Mass Spectrometer," *Rapid Comm in Mass Spectrom*, (6), pp. 313-317, (1992).

(Continued)

*Primary Examiner* — Jack Berman
(74) *Attorney, Agent, or Firm* — Charles B. Katz

(57) ABSTRACT

A technique is disclosed for conducting collision induced dissociation (CID) in a quadrupole ion trap (QIT) having higher order field components. In order to compensate for the shift in the frequency of motion with amplitude of the excited ions arising from the influence of higher-order field components, the amplitude of the RF voltages applied to the QIT is monotonically varied during the excitation period to prolong the condition of resonance, resulting in higher average kinetic energies of the excited ions. Thus, higher fragmentation efficiencies may be obtained, or a targeted level of fragmentation may be achieved in less time relative to conventional CID.

16 Claims, 4 Drawing Sheets

U.S. PATENT DOCUMENTS

| | | | |
|---|---|---|---|
| 5,521,380 | A | 5/1996 | Wells et al. |
| 5,528,031 | A | 6/1996 | Franzen |
| 5,561,291 | A | 10/1996 | Kelley et al. |
| 5,572,022 | A | 11/1996 | Schwartz et al. |
| 5,608,216 | A | 3/1997 | Wells et al. |
| 5,610,397 | A | 3/1997 | Kelley |
| 5,679,951 | A | 10/1997 | Kelley et al. |
| 5,696,376 | A | 12/1997 | Doroshenko et al. |
| 5,864,136 | A | 1/1999 | Kelley et al. |
| 6,093,929 | A | 7/2000 | Javahery et al. |
| 6,124,591 | A | 9/2000 | Schwartz et al. |
| 6,147,348 | A | 11/2000 | Quarmby et al. |
| 6,410,913 | B1 | 6/2002 | Brekenfeld et al. |
| 6,710,336 | B2 | 3/2004 | Wells |
| 6,753,523 | B1 | 6/2004 | Whitehouse et al. |
| 6,770,872 | B2 | 8/2004 | Bateman et al. |
| 6,884,996 | B2 | 4/2005 | Senko |
| 6,949,743 | B1 | 9/2005 | Schwartz |
| 7,102,129 | B2 | 9/2006 | Schwartz |
| 7,456,396 | B2 | 11/2008 | Quarmby et al. |
| 2004/0021070 | A1 | 2/2004 | Bateman et al. |
| 2004/0021072 | A1 | 2/2004 | Soudakov et al. |
| 2004/0079874 | A1 | 4/2004 | Bateman et al. |
| 2005/0263695 | A1 | 12/2005 | Syka |
| 2007/0084994 | A1 | 4/2007 | Wang et al. |
| 2007/0164208 | A1 | 7/2007 | Quarmby et al. |
| 2008/0073508 | A1 | 3/2008 | Hashimoto et al. |
| 2008/0210860 | A1 | 9/2008 | Kovtoun |

OTHER PUBLICATIONS

Splendore et al., "A Simulation Study of Ion Kinetic Energies During Resonant Excitation in a Stretched Ion Trap," *Intl J. Mass Spectrom and Ion Processes*, Elsevier Sciences B.V., (156), pp. 11-29, (1996).

Reid et al, "Time Delayed Fragmentation Using a Hybrid RF/DC Quadrupole-Linear Ion Trap Mass Spectrometer," *Proceedings of the 50th ASMS Conference on Mass Spectrometry and Allied Topics*, Orlando, Florida, 2 pages, (2002).

Murrell et al. —Fast Excitation"CID in a Quadrupole Ion Trap Mass Spectrometre," *J. Am Mass Spectrom*, Elsevier Inc., pp. 785-789, (Jun. 2, 2003).

Hager, James W., "Product Ion Spectral Simplification Using Time-Delayed Fragment Ion Capture with Tandem Linear Ion Traps," *Rapid Comm in Mass Spectrom*, (17), pp. 1389-1398, (2003).

Frank et al., "Evaluation of a Linear Quadrupole Ion Trap with Added Octopole Fields Combined with Time of Flight Mass Spectrometry," Presented at ASMS 2003, 2 pages, (2003).

PROLONGED ION RESONANCE COLLISION INDUCED DISSOCIATION IN A QUADRUPOLE ION TRAP

CROSS-REFERENCE TO RELATED APPLICATIONS

This application claims the priority benefit under 35 U.S.C. §119(e) of U.S. Provisional Patent Application No. 61/176,349 filed May 7, 2009, by Remes et al., the disclosure of which is incorporated herein by reference.

FIELD OF THE INVENTION

The present invention relates generally to techniques for dissociating ions in mass spectrometric analysis, and more particularly to a method and apparatus for improving the efficiency of collision induced dissociation (CID) in a quadrupole ion trap.

BACKGROUND OF THE INVENTION

Collision induced dissociation (CID) is a widely-used technique for the controlled fragmentation of precursor ions in a quadrupole ion trap (QIT). CID is commonly performed by applying a dipolar oscillatory excitation voltage to opposite QIT electrodes, also referred to as supplementary excitation. When the excitation voltage has a frequency at or near an ion's frequency of motion, energy from this field will be absorbed by the ion, increasing the ion's kinetic energy. The increased kinetic energy is converted into internal energy via collisions with the buffer gas, which can cause the ion to dissociate.

As the ion is excited, the amplitude of its oscillatory motion grows larger. In a pure quadrupolar field with no buffer gas collisions, the ion amplitude would grow linearly with time, where the slope of this growth is determined by the magnitude of the resonant excitation field. In a pure quadrupolar field, the electric field, and thus the force on an ion, varies linearly with its position, as in Equation 1, below:

$$E_x = -\frac{\Phi_0}{r_0^2}x \tag{1}$$

where $E_x$ is the electric field in the x direction, $\Phi_0$ is the voltage difference between opposite rods, and $r_0$ is the field radius. However, all QITs incorporate some proportion of higher order non-linear field components due to the truncation of the hyperbolic surfaces, the adaptation of one or more electrodes with ejection apertures, and departures from ideal surface geometry and electrode spacing caused by manufacturing errors and tolerances. As an example, the electric field contribution from an octopolar field, for comparison, is given in Equation 2.

$$E_x = -\frac{2\Phi_0}{r_0^4}[x^3 - 3xy^2] \tag{2}$$

In an octopolar field (or other higher order field), the force on an ion varies with position in a non-linear fashion. "Cross terms" also are to be found in these fields, where the force depends on the ion position in the y or z dimensions in addition to its position in the x dimension. The influence of higher order fields causes the amplitude growth of an ion's motion during excitation to be non-linear with time, and at large displacements the frequency of ion oscillation changes. Due to the resonant nature of the excitation process, the effect of the resonance excitation field is diminished as the ion frequency shifts away from the frequency of the excitation voltage. The ion may be subsequently returned to a resonance condition as the result of collisions with the buffer gas, which reduce the ion's amplitude of motion and cause the ions frequency to shift back to its original value. The amplitude of ion motion and the frequency of ion oscillations will fluctuate in a beating pattern as the ion comes into and out of resonance with the supplementary excitation field, as illustrated in FIG. 1.

The transfer of ion kinetic energy into ion internal energy via buffer gas collisions has been extensively modeled in the mass spectrometry literature, and the outcome of a collision has been shown to depend on the relative kinetic energy of the ion/neutral encounters, as well as the internal energy of the ion. When collisions occur with high relative kinetic energy and the ion has low internal energy, the ion internal energy will tend to increase. In contrast, when collisions have lower relative kinetic energy and the ion has high internal energy, the ion internal energy will tend to decrease. Therefore, when the ion shifts out of resonance with the supplementary excitation field and collisions occur, the ion kinetic energy is quickly lost, resulting in reduction of internal energy deposition in subsequent collisions. This phenomenon results in decreased ion fragmentation efficiency, thereby reducing the number of product ions formed in a given time and requiring longer times (relative to fragmentation in a hypothetical pure quadrupolar field) to achieve a targeted abundance of product ions.

Against this background, there is a need in the mass spectrometry art for a method and apparatus for performing CID in a QIT with improved dissociation efficiency, thereby enhancing instrument sensitivity and/or throughput.

SUMMARY

Embodiments of the present invention provide a modified technique for performing CID in a QIT. According to this technique, the amplitude of the RF trapping voltages applied to QIT electrodes is monotonically varied over a prescribed range during the excitation period, which correspondingly changes the Mathieu parameter q and the secular frequencies of the trapped ions. The variation in trapping voltage amplitude compensates for the shift in the frequency of motion of the excited ions attributable to the influence of non-linear field components, which allows more energy from the excitation field to be transferred to the ions in a given time, resulting in higher average kinetic energies of the excited ions. In this manner, higher maximum fragmentation efficiencies may be obtained, or a targeted level of fragmentation may be achieved in less time relative to the conventional CID operating mode, wherein the RF trapping voltage is maintained substantially invariant during the excitation period. Depending on the specific characteristics of the dominant non-linear field component, the variation of the RF trapping voltage amplitude may be either downward or upward.

DETAILED DESCRIPTION OF EMBODIMENTS

Embodiments of the invention are described below in connection with their implementation in a particular QIT design, namely the four-slotted stretched two-dimensional QIT described in U.S. patent application Ser. No. 12/205,750 by Schwartz entitled "Two-Dimensional Radial-Ejection QIT Operable as a Quadrupole Mass Spectrometer", the disclosure of which is incorporated herein by reference. It should be understood that this QIT configuration is presented by way of providing a non-limiting example of an environment in which the presently disclosed CID techniques may be implemented, and that embodiments of the present invention may be effectively used in connection with many variations of the QIT design, including three-dimensional QITs, cylindrical QITs, and rectilinear QITs. Furthermore, the QIT in which CID is performed need not be employed for mass analysis of the product ions formed by CID; for example, the product ions may be ejected from the QIT to a downstream mass analyzer for subsequent processing and/or mass analysis. Still further, alternative implementations of the present method may be utilized in connection with ion traps having a primarily non-quadrupolar (e.g., predominantly octopolar) trapping field.

Figure 1:
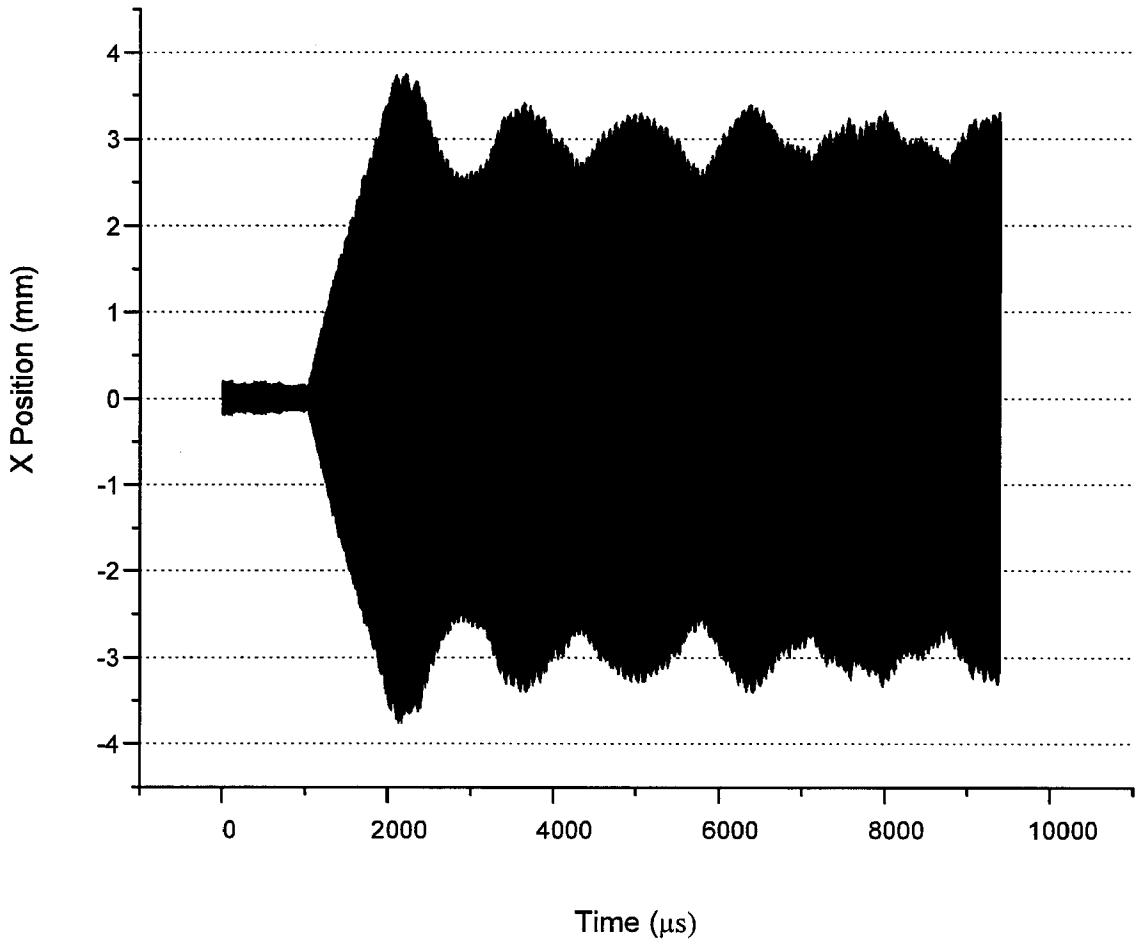
FIG. 1 is a graph depicting motion of an ion excited by conventional CID in a QIT, showing in particular the beating pattern arising from the influence of higher order fields.
Figure 2:
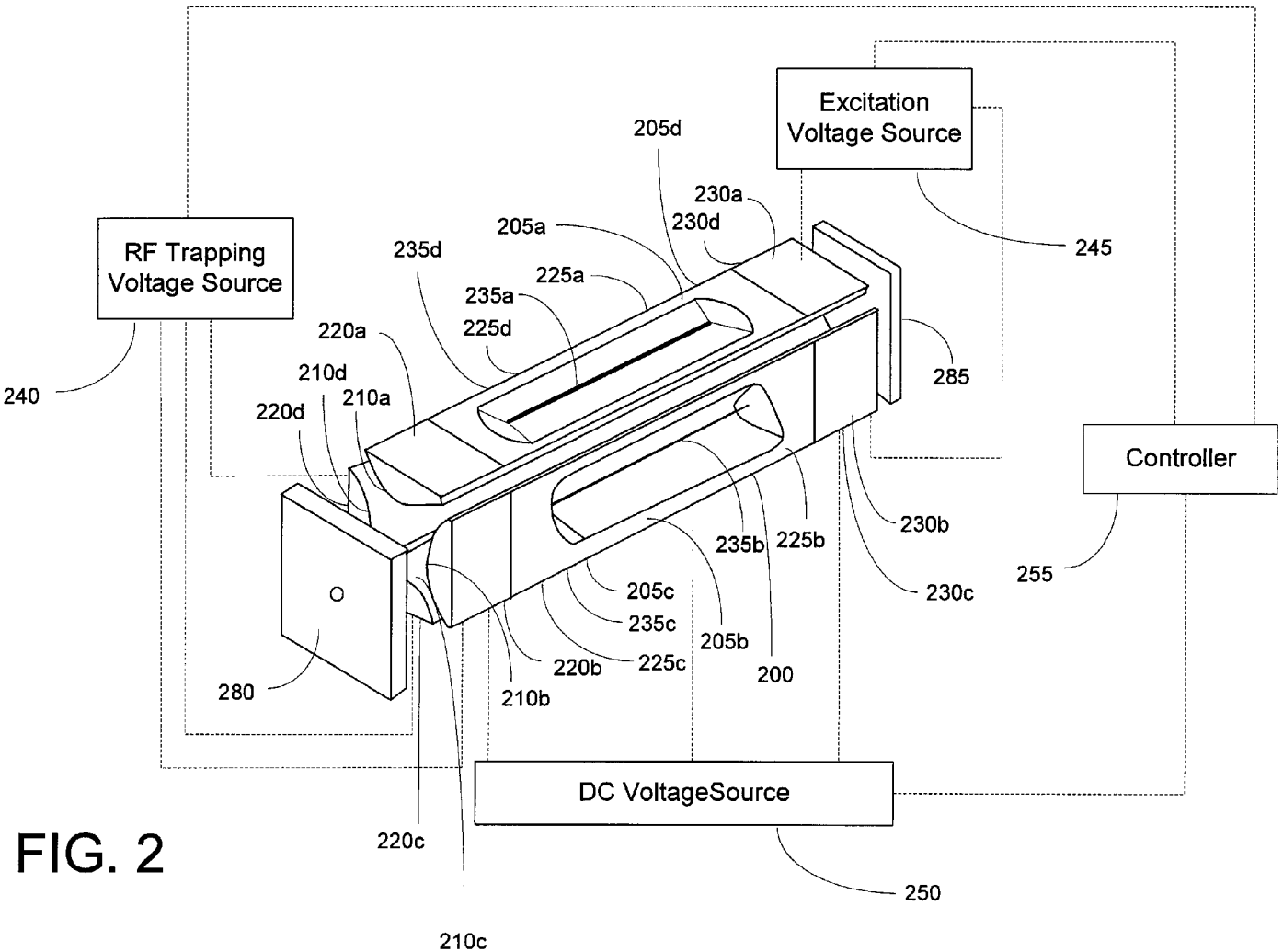
FIG. 2 is a perspective view of a two-dimensional QIT mass analyzer in which the CID techniques of the present invention may be implemented.

FIG. 2 is a perspective view of a QIT 200. QIT 200 includes four elongated electrodes 205*a,b,c,d* arranged in mutually parallel relation about a centerline 210. Each electrode 205*a,b,c,d* has a truncated hyperbolic-shaped surface 210*a,b,c,d* facing the interior volume of QIT 200. In a preferred implementation, each electrode is segmented into a front end section 220*a,b,c,d*, a central section 225*a,b,c,d*, and a back end section 230*a,b,c,d*, which are electrically insulated from each other to allow each segment to be maintained at a different DC potential. For example, the DC potentials applied to front end sections 220*a,b,c,d* and to back end sections 230*a,b,c,d* may be raised relative to the DC potential applied to central section 225*a,b,c,d* to create a potential well that axially confines positive ions to the central portion of the interior of QIT 200. Each electrode 205*a,b,c,d* is adapted with an elongated aperture (slot) 235*a,b,c,d* that extends through the full thickness of the electrode to allow ions to be ejected therethrough in a direction that is generally orthogonal to the central longitudinal axis of QIT 200. Slots 235*a,b,c,d* are typically shaped such that they have a minimum width at electrode surface 210*a,b,c,d* (to reduce field distortions) and open outwardly in the direction of ion ejection. Optimization of the slot geometry and dimensions to minimize field distortion and ion losses is discussed by Schwartz et al. in U.S. Pat. No. 6,797,950 ("Two-Dimensional Quadrupole QIT Operated as a Mass Spectrometer"), the disclosure of which is incorporated herein by reference.

Electrodes 205,*a,b,c,d* (or a portion thereof) are coupled to an RF trapping voltage source 240, excitation voltage source 245, and DC voltage source 250, all of which communicate with and operate under the control of controller 255, which forms part of the control and data system. Controller 255 may be implemented as any one or combination of application-specific circuitry, specialized or general purpose processors, volatile or nonvolatile memory, and software or firmware instructions, and its functions may be distributed among two or more logical or physical units. RF trapping voltage source 240 is configured to apply RF voltages of adjustable amplitude in a prescribed phase relationship to pairs of electrodes 205*a,b,c,d* to generate a trapping field that radially confines ions within the interior of QIT 200. In a typical mode of operation, the RF trapping voltage source applies sinusoidal voltages of equal amplitude and opposite phase to aligned pairs of electrodes, such that at any given time point one aligned electrode pair receives a voltage opposite in polarity relative to the voltage applied to the other aligned electrode pair. In one illustrative implementation, excitation voltage source 245 applies an oscillatory excitation voltage of adjustable amplitude and frequency across at least one pair of opposed electrodes to create a dipolar excitation field that resonantly excites ions for the purposes of isolation of selected species, collision induced dissociation (CID), and mass-sequential analytical scanning. In alternative implementations, the oscillatory excitation voltage is applied to a single electrode. This mode of excitation, sometimes referred to as monopolar excitation, actually produces a combination of dipolar and quadrupolar excitation. DC voltage source 250 is operable to apply DC potentials to electrodes 205*a,b,c,d* or sections thereof, and/or to end lenses 280 and 285, to generate a potential well that axially confines ions within QIT 200.

As described in the aforementioned Schwartz et al. patent application, electrodes 205*a,b,c,d* may be symmetrically outwardly displaced ("stretched") relative to the hyperbolic radius $r_0$ defined by the electrode surfaces in order to reduce the undesirable impact of the non-linear fields caused by the slots, while keeping the centerline RF potential to a minimum. However, this trap geometry still produces higher-order field components that potentially interfere with the resonant excitation process. This detrimental effect is reduced in embodiments of the present invention by monotonically varying the amplitude of the RF trapping voltages during resonant excitation to prolong the time during which the excited ions are in resonance with the exciting field.

Figure 3:
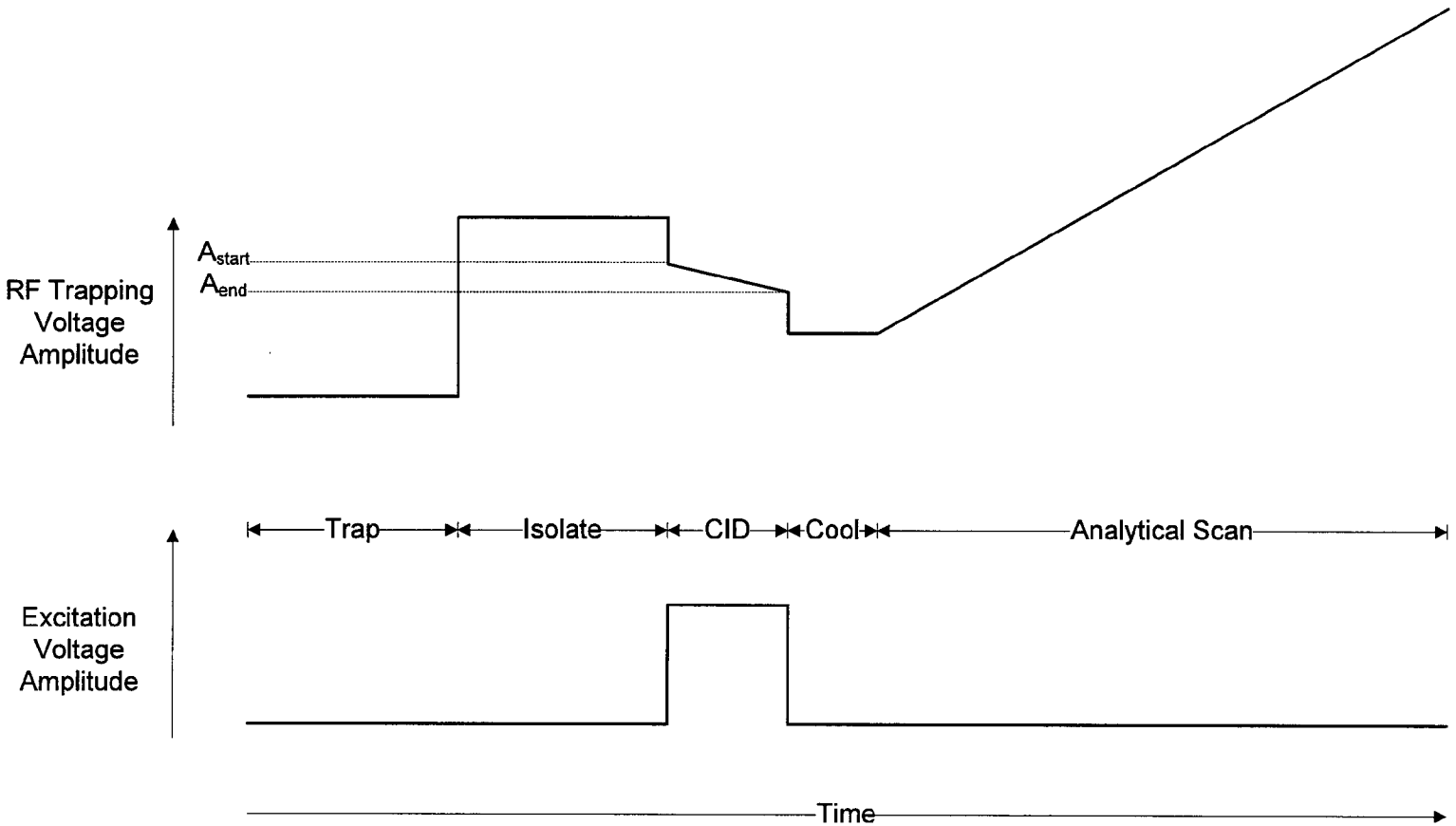
FIG. 3 is a timing diagram showing the application of radio frequency (RF) and excitation voltages during the excitation period.

FIG. 3 is a timing diagram depicting the application of the RF trapping and resonant excitation voltages to QIT 200 during an MS/MS analysis cycle. As shown, the CID or excitation period is preceded by a trapping period, during which ions (which may be formed in any suitable ion source and transported to ion trap 200 by a conventional arrangement of ion optic elements) are injected into and trapped within the interior volume of QIT 200, and an isolation period, during which ions having mass-to-charge ratios (m/z's) outside of a selected range are ejected from QIT 200. Techniques for isolating a selected ion species in QIT 200, e.g., by application of a notched multi-frequency ejection waveform, are well known in the art and hence need not be discussed herein.

At the beginning of the CID excitation period, the amplitude of the RF trapping voltage is set by controller 255 to a value $A_{start}$, and the excitation voltage is applied across electrodes of QIT 200. The excitation voltage will typically take the form of a simple oscillatory (e.g., sinusoidal) waveform having a frequency f. The frequency f may be set equal to a fraction (e.g., an integer fraction) or non-fractional value of the frequency v of the RF trapping voltage, and will determine the value of the Mathieu stability parameter q at which resonance will occur. In one illustrative example, f is set equal to 1/11*v, which produces resonant excitation of ions at about q=0.25. The amplitude of the excitation voltage will typically be held constant during the excitation period, but may in certain implementations be varied during excitation. The value of the excitation voltage amplitude may be set in accordance with a calibrated relationship based on the mass-to-charge ratio (m/z) of the selected precursor ions.

During the CID excitation period, controller 255 monotonically varies (i.e., exclusively increases or decreases) the amplitude of the RF trapping voltages to counteract the effect of the higher order field components and prolong the resonance condition. The direction of the variation that produces the desired effect will depend on the sign and order of the non-linear field components, which determine the direction of secular frequency change with increasing amplitude of ion motion. In the example depicted in FIG. 3, the RF trapping voltage amplitude is monotonically decreased over the CID excitation period from an initial value of $A_{start}$ to a final value of $A_{end}$. While the RF trapping voltage amplitude is shown as decreasing in a continuous linear fashion, in other implementations controller 255 may vary the amplitude in a stepwise or non-linear manner. The duration of the excitation period, which may be set manually or via an automated process, will typically be in the range of 5-50 milliseconds (ms).

Selection of the optimal values of $A_{start}$ and $A_{end}$ will depend on the m/z of the ion species of interest (i.e., the ion species chosen for MS/MS or $MS^n$ analysis), as well as consideration of the precursor ion m/z range, the excitation time, and the specific characteristics, and relative amplitudes of the non-linear field components (and their effect on the variation of ion frequency with amplitudes of motion). In the example cited above, where f=1/11*v, $A_{start}$ and $A_{end}$ may be set to place an ion species of m/z 524 (MRFA) at a q of 0.248 and 0.252, respectively. $A_{start}$ and $A_{end}$ may be regarded as defining (in accordance with the well-known relationship between q, m/z, and the RF trapping voltage amplitude) a scan range of m/z values of ions brought into resonance with the excitation field during variation of the RF trapping voltage amplitude, disregarding the effects of nonlinear field components. The scan range will typically be approximately 2-10 Th (m/z units). The aforementioned example, wherein the amplitude is varied to ramp the q of an m/z 524 ion between 0.248 and 0.252, represents a scan range of about 6 Th. For a typical excitation period duration of 10 ms, the resultant scan rate during excitation is about 0.6 Th/ms. The instrument-specific optimal values of $A_{start}$ and $A_{end}$ may be empirically determined for a set of calibrant ions in a calibration procedure, and the determined values (or a functional representation thereof) may be stored by controller 255 so that the RF trapping amplitude may be varied during CID using the empirically-derived optimized values.

At the completion of the excitation period, the excitation voltage is terminated and the amplitude of the RF trapping voltage is reduced to allow for cooling of the product and residual precursor ions. The ions may then be scanned out of QIT 200 in order of the m/z's to produce a mass spectrum by ramping the RF trapping voltage while applying a resonant ejection voltage, in accordance with the resonant scanning technique well known in the art. Alternatively, further stages of ion isolation and CID (i.e., $MS^n$ analysis) may be performed prior to acquiring the mass spectrum. Further alternatively, the product ions may be transferred to another mass analyzer for acquisition of the mass spectrum.

Figure 4:
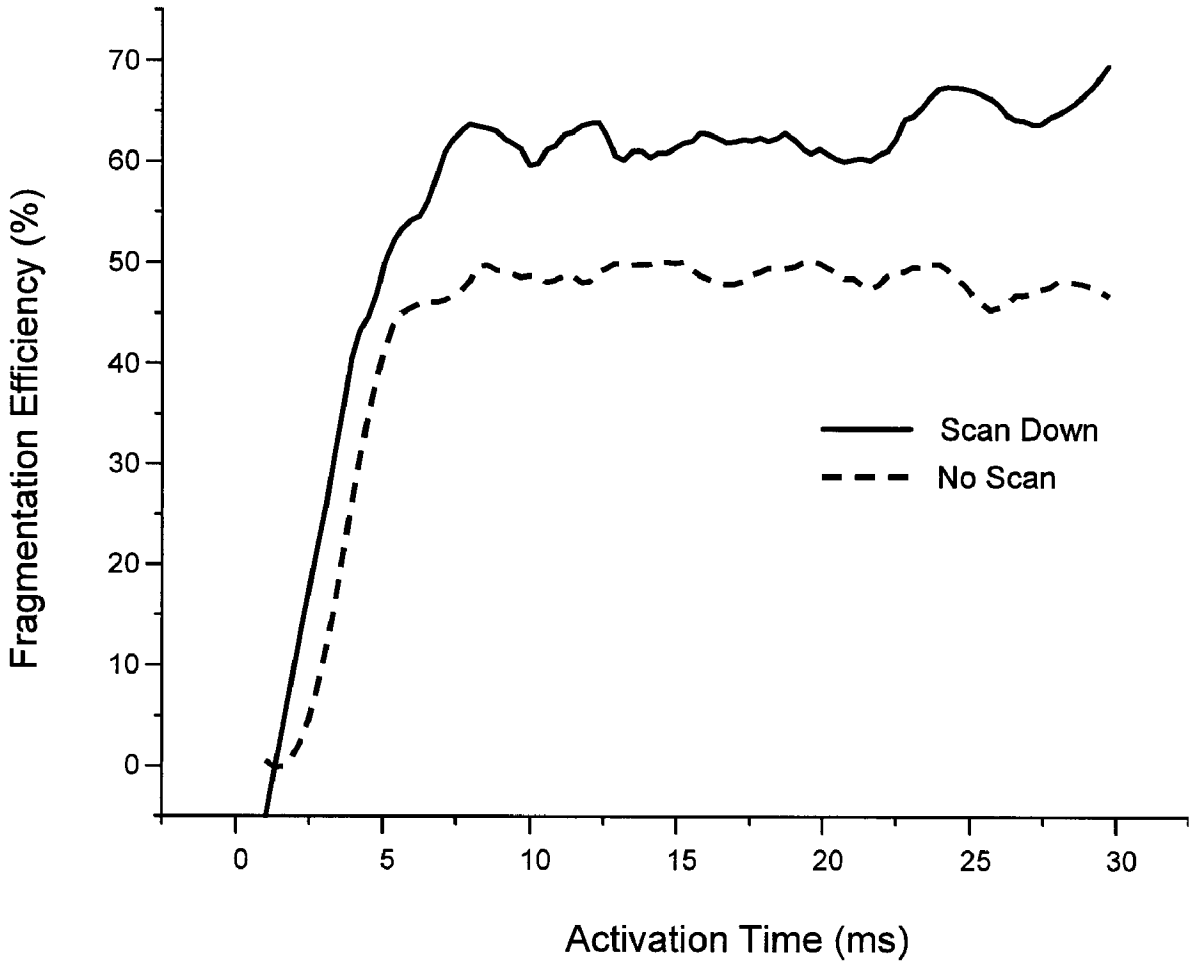
FIG. 4 is a graph comparing the variation of fragmentation efficiency with excitation duration in cases where (i) the RF voltage amplitude is held constant during the excitation period, and (ii) the RF voltage amplitude is monotonically varied during the excitation period.

The effect of monotonically varying the RF trapping voltage amplitude during the CID excitation period has been investigated by performing a series of MS/MS experiments on a specially modified Thermo Scientific ion trap mass spectrometer. FIG. 4 depicts the variation of fragmentation efficiency of an m/z 524 (MRFA) precursor ion with excitation period duration under conditions where (i) the RF trapping voltage amplitude is held substantially constant during excitation, and (ii) the RF trapping voltage amplitude is decreased monotonically during excitation in accordance with an embodiment of the invention. Decreasing the RF voltage amplitude during excitation causes the fragmentation efficiency to rise more quickly with duration, and to reach a plateau having a higher value of efficiency (about 60% vs. about 50% for the constant RF trapping voltage amplitude condition). Thus, a targeted degree of fragmentation can be attained more quickly when the RF trapping voltage amplitude is decreased during excitation; for example, a targeted value of 50% is reached at about 5 ms duration, vs. about 10 ms for the constant RF amplitude condition. The increased fragmentation rate reduces the required fragmentation time improving overall cycle time and throughput. Alternatively, greater numbers of product ions may be produced for a given excitation duration, thereby increasing sensitivity relative to conventional CID operation.

In alternative embodiments of the invention, controller 255 is configured to monotonically vary the frequency v of the RF trapping voltage or the frequency f of the excitation voltage during the excitation period in order to equivalently prolong resonance and improve fragmentation efficiency. Since the Mathieu parameter q of an ion has an inverse dependence on the square of the trapping voltage frequency ($v^2$), the negative effects of the higher-order field components may equally be avoided by appropriately varying the trapping voltage frequency or excitation frequency during the excitation process. These frequency variations may be employed in place of or in addition to variation of the trapping voltage amplitude. Selection of the optimal start and end values of v or f will depend on the m/z of the ion species of interest, as well as consideration of the precursor ion m/z range and the specific characteristics and relative amplitudes of the non-linear field components. In a typical implementation, the start and end values of v or f define a scan range between 2-10 Th, centered on the m/z of the ion species of interest.

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. A method for dissociating ions in a quadrupole ion trap for mass spectrometric analysis, comprising:

applying RF voltages of adjustable amplitude to the ion trap to generate an RF trapping field that confines ions within the ion trap;

applying an oscillatory excitation voltage to the ion trap for a collision induced dissociation (CID) excitation period to kinetically excite at least some of the confined ions; and monotonically varying the amplitude of the RF voltages during the CID excitation period.

2. The method of claim 1, wherein the amplitude of the RF voltages is varied downwardly during the CID excitation period.

3. The method of claim 2, wherein the amplitude of the RF voltages is varied upwardly during the CID excitation period.

4. The method of claim 1, wherein the amplitude of the RF voltages is varied between a first value and a second value, the range defined by the first and second values corresponding to a shift of between 2 and 10 Th.

5. The method of claim 4, wherein the range is centered on the mass-to-charge ratio of a range of selected ions.

6. The method of claim 1, wherein the oscillatory excitation voltage is applied continuously during the CID excitation period.

7. The method of claim 1, wherein the oscillatory excitation voltage is applied at a single frequency.

8. A quadrupole ion trap, comprising:

a plurality of electrodes defining an interior region;

an RF trapping voltage source for applying RF voltages to at least a first portion of the plurality of electrodes to generate a trapping field that confines ions to the interior region;

an excitation voltage source for applying an oscillatory excitation voltage to at least a second portion of the plurality of electrodes for a collision induced dissociation (CID) excitation period to kinetically excite at least some of the confined ions; and a controller configured to cause the RF trapping voltage source to monotonically vary the amplitude of the RF voltages during the CID excitation period.

9. The quadrupole ion trap of claim 8, wherein the controller is configured to vary the amplitude of the RF voltages downwardly during the CID excitation period.

10. The quadrupole ion trap of claim 8, wherein the controller is configured to vary the amplitude of the RF voltages upwardly during the CID excitation period.

11. The quadrupole ion trap of claim 8, wherein the interior region is elongated along a central axis.

12. The quadrupole ion trap of claim 8, wherein the excitation voltage is applied at a single frequency.

13. A method for dissociating ions in a quadrupole ion trap for mass spectrometric analysis, comprising:

applying RF voltages to the ion trap to generate an RF trapping field that confines ions within the ion trap, wherein the RF trapping field has a substantial higher-order field component that causes the frequency of ion motion to vary with amplitude in at least one dimension of the ion trap;

applying an excitation voltage to the ion trap for a collision induced dissociation (CID) excitation period to kinetically excite at least a portion of the confined ions; and monotonically varying at least one of a parameter of the applied RF voltages and a parameter of the excitation voltage during the CID excitation period to shift the frequency of ion motion.

14. The method of claim 13, wherein the monotonically varying step comprises monotonically varying the RF voltage amplitude.

15. The method of claim 13, wherein the monotonically varying step comprises varying the RF voltage frequency.

16. The method of claim 13, wherein the monotonically varying step comprises varying the excitation voltage frequency.

* * * * *